US005457850A

United States Patent [19]

Knox

[11] Patent Number: 5,457,850

[45] Date of Patent: Oct. 17, 1995

[54] PLASTIC BAIL HANDLE

[75] Inventor: Jerry L. Knox, Garrettsville, Ohio

[73] Assignee: Cardinal Packaging, Inc., Streetsboro, Ohio

[21] Appl. No.: 199,429

[22] Filed: Feb. 18, 1994

Related U.S. Application Data

[63] Continuation of Ser. No. 911,517, Jul. 10, 1992, Pat. No. 5,287,990.

[51] Int. Cl.[6] ..... B65D 25/28

[52] U.S. Cl. ..... 16/114 R; 220/760; 220/773

[58] Field of Search ..... 16/113, 114 R; 220/759, 760, 773, 776

[56] References Cited

U.S. PATENT DOCUMENTS

| | | | |
|---|---|---|---|
| 956,349 | 4/1910 | Hickey | 220/760 |
| 2,176,711 | 10/1939 | Gorman, Jr. . | |
| 2,413,280 | 12/1946 | Ashenden . | |
| 2,879,916 | 3/1959 | Hoffmann et al. . | |
| 3,093,257 | 6/1963 | Miller . | |
| 3,128,905 | 4/1964 | Hesslein . | |
| 3,339,794 | 9/1967 | Oberlander et al. | 220/760 |
| 3,619,852 | 11/1971 | Eckberg . | |
| 3,861,733 | 1/1975 | Vander Mey . | |
| 3,923,191 | 12/1975 | Johnson . | |
| 4,023,702 | 5/1977 | McKight | 16/114 R |
| 4,196,321 | 4/1980 | Teti, Jr. et al. . | |
| 4,215,789 | 8/1980 | Pfeifer . | |
| 4,351,448 | 9/1982 | Ingersoll et al. . | |
| 4,393,540 | 7/1983 | Yamamoto et al. | 16/114 R |
| 4,673,625 | 6/1987 | McCartney et al. | 220/760 |
| 4,799,306 | 1/1989 | Collins et al. . | |
| 4,997,098 | 3/1991 | Buza et al. . | |
| 5,088,615 | 2/1992 | Neuman . | |
| 5,287,990 | 2/1994 | Knox | 220/760 |

FOREIGN PATENT DOCUMENTS

| | | |
|---|---|---|
| 2489260 | 3/1982 | France . |
| 2811141 | 9/1978 | Germany . |
| 675695 | 11/1964 | Italy . |
| 1586110 | 3/1981 | United Kingdom . |

*Primary Examiner*—Stephen J. Castellano
*Attorney, Agent, or Firm*—Fay, Sharpe, Beall, Fagan, Minnich & McKee

[57] ABSTRACT

A plastic container includes a plastic bail-type handle. The ends of the handle include an improved bayonet-type connection. The connection has a solid cross section permitting it to withstand greater forces imposed on the handle. An elongated shoulder is also embodied in the connection for abutting engagement with an associated bail ear provided on the container.

3 Claims, 3 Drawing Sheets

PLASTIC BAIL HANDLE

This is a continuation of application Ser. No. 07/911,517, filed Jul. 10, 1992 now U.S. Pat. No. 5,287,990.

BACKGROUND OF THE INVENTION

This application pertains to the art of plastic containers and more particularly to plastic pails having plastic bail-type handles secured thereto. The invention is particularly applicable to plastic pails that are subject to low temperatures, for example, when used for storing frozen food products such as ice cream or the like. However, it will be appreciated that the invention has broader applications and may be advantageously employed for packaging other food products, as well as in other environments and applications.

An injection molded plastic container of the type generally used to package food products includes a one-piece or unitary cylindrical container. Usually, the container is formed in a molding operation such that the container is closed at a bottom end and a circumferentially continuous sidewall tapers generally laterally outward as the container extends from the closed end to an upper or open end. As will be appreciated, the tapering conformation allows open ended containers to be nested one inside the other to thereby limit the amount of space required to ship unfilled containers. The upper end of each container includes a lip or rim that lockingly cooperates with a separately formed closure member or lid. The lid, likewise, includes a lip portion adapted to snap fit and securely lock over the rim to close the container.

Also provided adjacent the upper edge of each container are a pair of bail ears. Preferably, the bail ears are integrally molded of the same plastic as the remainder of the container, for example, recyclable high density polyethylene. The bail ears extend radially outward from the container sidewall and are disposed diametrically opposite one another to provide balance when the container is carried by the bail. Each ear includes a smooth-walled mounting face spaced outwardly from the remainder of the container sidewall and has an aperture extending therethrough adapted to receive opposed ends of the bail. For example, commercially available containers use a bail formed from metal wire stock. Opposed ends of the bails have a generally arcuate or U-shape configuration for receipt in the openings of the bail ears. This arrangement permits selective pivotal movement of the handle relative to the container. Further details of this type of container may be found in commonly assigned U.S. Pat. No. 4,997,098, the disclosure of which is hereby incorporated by reference.

Although containers of this general type have met with commercial success, the metal bail, although still the most commonly used type of bail, is not preferred for all situations. There are some problems associated with its use. For example, there is the potential for puncturing the plastic container, particularly when the container is exposed to subfreezing temperatures. During the packaging and distribution process at sub-zero temperatures, plastic has a greater chance of breaking because of its brittle nature at the low temperatures. If impact occurs, the metal handle may be driven through the brittle plastic and may break away a piece of plastic into the contents of the package. In the case of food products, the risk of a plastic piece being lodged in the food product is undesirable. This problem is generally known in the industry as coining.

Another problem associated with a metal bail is the potential for interference with a metal detector installed in a food processing plant used to monitor the infeeding of the food product into a container. The metal detector eliminates the potential for undesirable metal inadvertently becoming intermixed with the food product. As will be apparent, the metal bail could "falsely" trigger the metal detector. Since the plastic container with a metal bail is otherwise desirable, alternative solutions to maintain the integrity of the metal detector, without unnecessarily tripping the detector as each metal bail passes, must be made.

Still another area of increasing concern is the ability to recycle containers. As with so many other products, the limited space remaining in landfills has brought an increased focus on the ability to recycle containers. Although the plastic container is itself recyclable, and the metal bails are also recyclable, the combined plastic and metal product is undesirable since it is considered a commingled product. That is, the container assembly includes different materials of construction which require dismantling or disassembly in order to separate the different, individual components, i.e., metal and plastic. Additional handling and expense are thus encountered at the recycling facility because of the use of different material components, if the facility accepts the commingled product at all.

Others in the industry have manufactured plastic handles or bails. Prior known plastic bails are expensive as a result of the intricate molding operation associated with forming the handle. Additionally, the mounting means for attaching the handle to the remainder of the container has also encountered problems. Representative of known plastic handles are U.S. Pat. No. 4,215,789 and published British Patent Specification 832,359. Those documents illustrate handle mounting arrangements in which an enlarged head is received through a smaller shaped opening and a necked down projection extends freely through the bail ear allowing selective articulation of the handle relative to the container. These types of arrangements, though, have a tendency to shear along the necked down region of the mounting means. No accommodation is made in the bails to accommodate outward stresses imposed thereon by, for example, a lid received on a container. Additionally, the low temperatures encountered have a tendency to make the small diameter connections very brittle and subject to breakage.

The subject invention is deemed to overcome these and a number of other problems.

SUMMARY OF THE INVENTION

The present invention contemplates a new and improved plastic container, including a plastic bail handle, that is simple to mold and yet overcomes the above noted problems.

According to a more limited aspect of the invention, the pail includes an integrally molded bottom and sidewall having an upper, open end adapted to receive a cooperating lid. A pair of bail receiving ears are defined on the sidewall and include an aperture or opening that cooperates with each bail end. Connection means includes a projection extending from each end of the bail. A circular convex cap is formed on the projection to expand the bail ear aperture and then allow the wall of the aperture to snap fit into a recess or reduced diameter region behind the cap. An elongated shoulder is provided on the other side of the recess to limit shear and breakage resulting from the imposition of pullout forces on the bail.

According to yet another aspect of the invention, the projection and cap have solid cross-sectional conformations for distributing the shear forces over a greater cross-sectional area.

According to a more limited aspect of the invention, the cap tapers radially outward to progressively enlarge the aperture as the bail end is inserted therein.

According to a still further aspect of the invention, each bail end is laterally offset from the remainder of the bail to accommodate a lid provided on the open end of the container.

A principal advantage of the invention is an all plastic handle that provides a secure engagement with the associated container.

Another advantage of the invention resides in the ability to easily accommodate a lid without imposing additional forces on the handle mounting structure.

Still another advantage of the invention is found in providing an all plastic, recyclable or reprocessed plastic.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
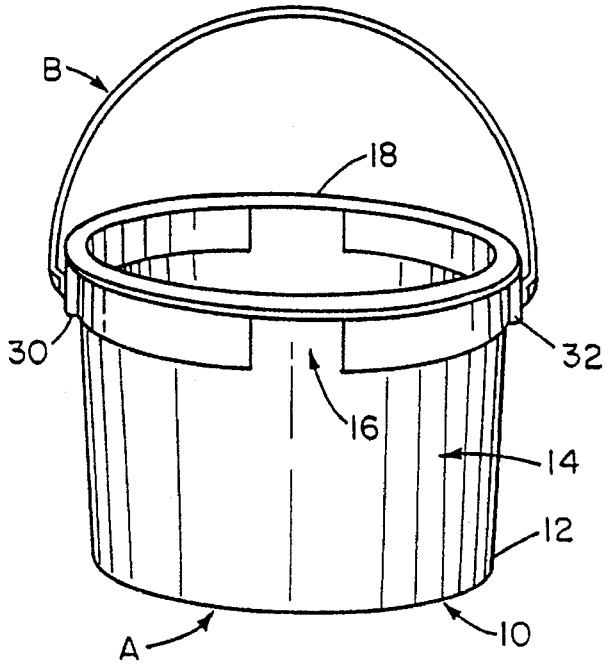
FIG. 1 is a front view of the subject container showing the bail handle in an upright, operative condition.
Figure 2:
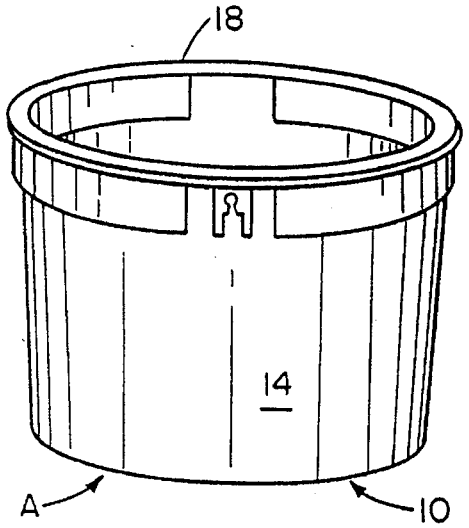
FIG. 2 is a side view of the container of FIG. 1.

Referring now to the drawings wherein the showings are for purposes of illustrating the preferred embodiment of the invention only and not for purposes of limiting same, the FIGURES show a plastic container or pail A having a plastic bail handle B secured thereto.

More particularly, the container is an integrally molded unit having a bottom 10 disposed at a first or lower end 12 of a circumferentially continuous sidewall 14. As will be appreciated, a second or upper end 16 of the sidewall terminates in a rim or lip 18. The sidewall of the container has a slight taper. More specifically, the sidewall increases in diameter as it extends from the lower end 12 toward the upper end 16. This permits one container to be received in a similar container in nested relation.

The lip 18 extends radially outward from the sidewall of the container and terminates in a downwardly facing edge 20 (FIG. 3) that cooperates with a lid (not shown) for closing of the second end of the container. Since details of the lid and its closing relation with the container lip are well known in the art, further discussion herein is deemed unnecessary.

Figure 3:
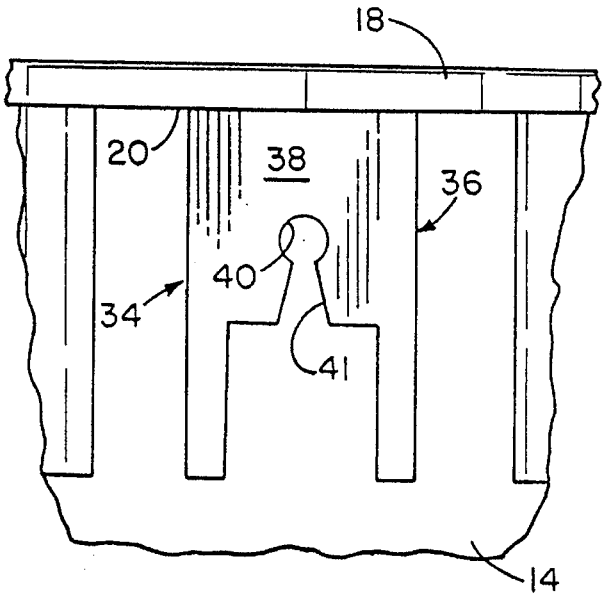
FIG. 3 is an enlarged elevational view of one of the bail ears.
Figure 4:
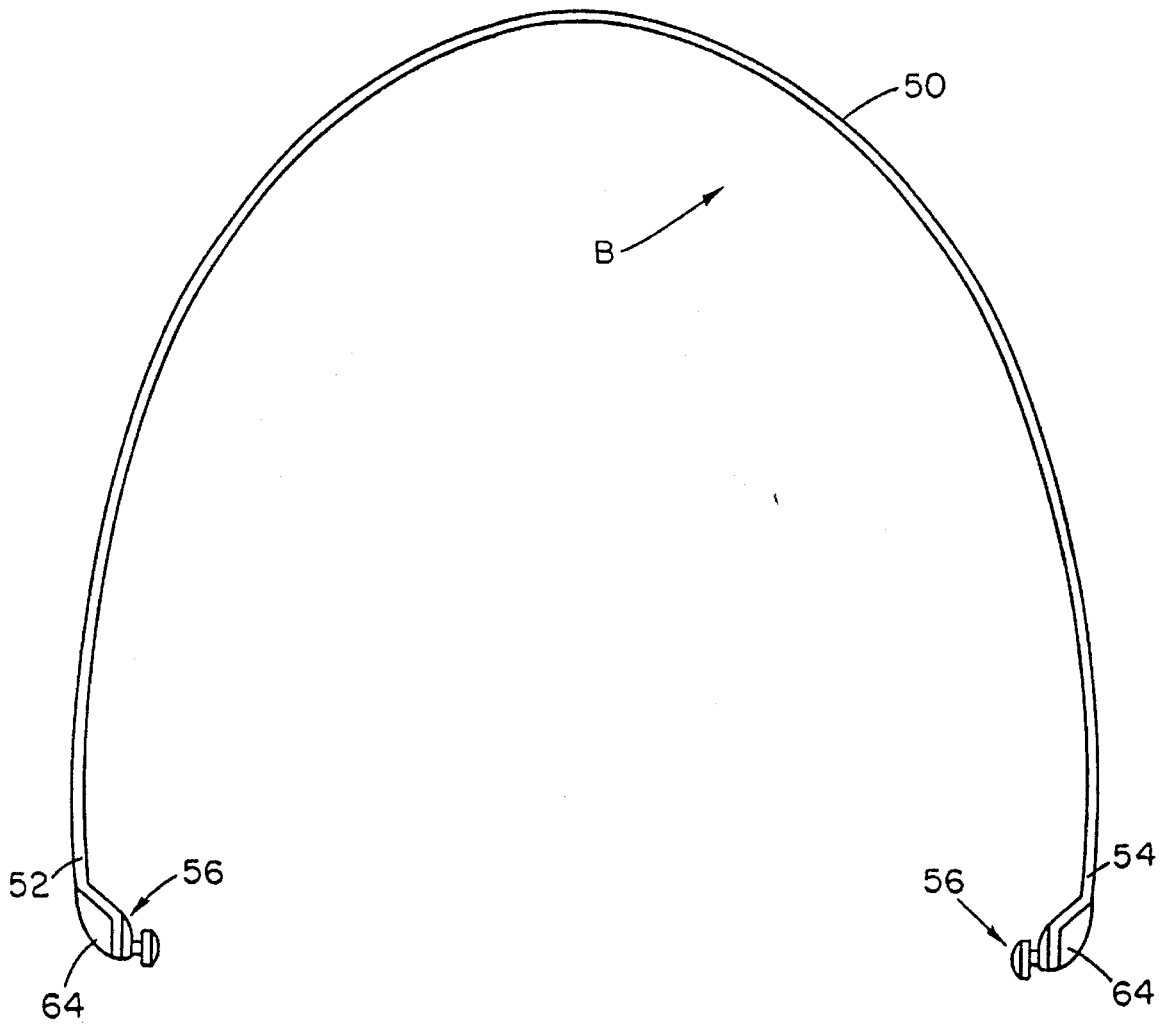
FIG. 4 is a plan view of the new bail handle.
Figure 7:
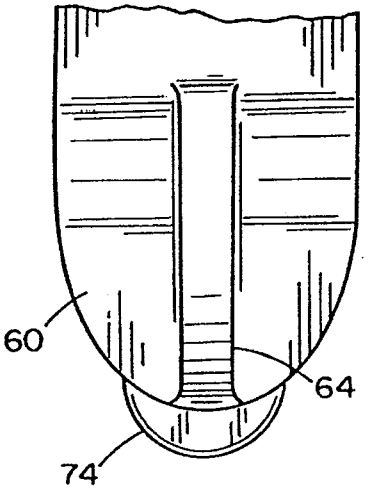
FIG. 7 is an end view taken generally from the right-hand side of FIG. 5.

Diametrically opposed bail ears 30, 32 (FIG. 1) are identical in construction so that description of one is equally applicable to the other. As shown in FIG. 3, one preferred arrangement comprises a pair of spaced, radially extending walls 34, 36 which are interconnected by a mounting face 38. Extending through the mounting face 38 is an aperture or opening 40, shown as a Church Key style slot that has a tapering or flared entry 41 that communicates with the enlarged rounded opening 40. Of course, still other style openings or slots can be used without departing from the scope and content of the subject invention. The aperture 40 extends only through the mounting face and does not extend through the sidewall 14. Thus, and as will be appreciated, the integrity of the sidewall is retained and the food product stored therein remains unaffected.

With additional reference to FIGS. 4–9, the particulars of the plastic bail handle B will be described in further detail. As shown there, the bail is an integrally molded one-piece plastic structure that has a generally constant cross-sectional configuration over its longitudinal extent, i.e., it is generally rectangular in cross-section. Although other cross-sections could be used with equal success, the flat, rectangular central portion 50 of the bail is one of the easiest to mold and provides sufficient area for gripping by the hand. At opposite ends 52, 54 of the bail handle, connecting means 56 are provided for selectively securing the bail to the container.

Figure 5:
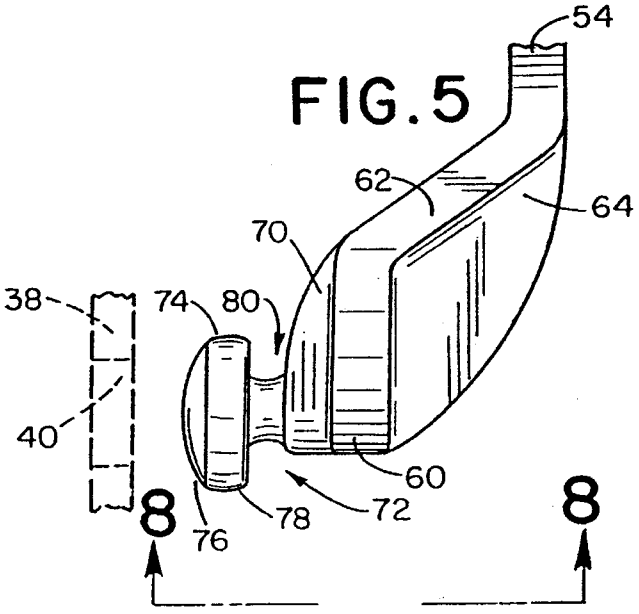
FIG. 5 is an enlarged, side elevational view of one end of the bail handle particularly illustrating the connection means and a portion of a bail ear shown in phantom.
Figure 8:
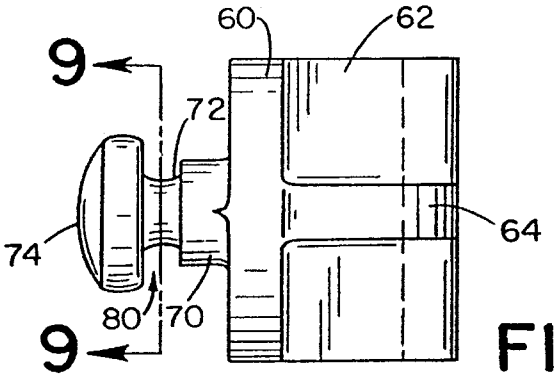
FIG. 8 is a view taken generally along the lines 8—8 of FIG. 5; and, FIG. 9 is a cross-sectional view taken generally along the lines 9—9 of FIG. 8.

Details of the connecting means are shown in the enlarged views of FIGS. 5–9. Particularly, each connecting means is identical so that the illustration and description of one is equally applicable to the other. As best illustrated in FIG. 5, the end of the bail handle is laterally offset at 60. Thus, a sloping, interconnecting portion 62 extends between the generally parallel portions 54, 60 of the bail handle. The connecting means 56, therefore, are easily secured to the opposed bail ears 30, 32 and the central portion 50 of the bail handle is located radially outward of the lip 18 of the container. In fact, the lateral offset is sufficient to accommodate a lid received over the rim when the container is closed. In this manner, the bail handle can be easily pivoted from its storage position without the lid or the rim engaging or interfering with this pivoting action.

A reinforcing member defined by a thin-walled ridge 64 extends generally perpendicular from the lateral offset 60 and interconnecting portion 62 to rigidify the arrangement. It also serves the additional purpose of assisting a user in grasping the end of the bail handle by means of the reinforcing ridge to insert the connection means into aperture 40 of the bail ear as will be described in further detail below.

Figure 6:
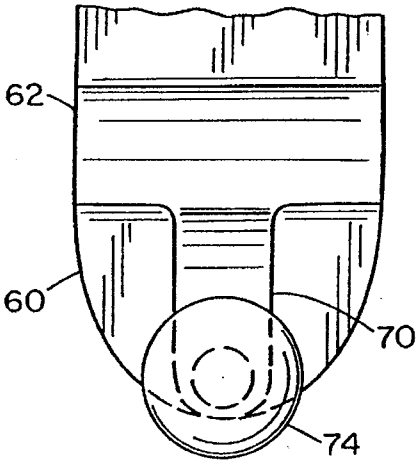
FIG. 6 is an end view taken generally from the left-hand side of FIG. 5.
Figure 9:
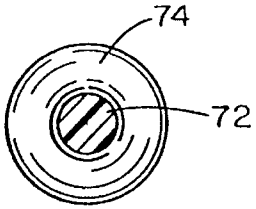

An elongated shoulder 70 has its lower portion extending generally perpendicular from the lateral offset 60 while its upper portion curves generally towards the angle of interconnecting portion 62. As best shown in FIG. 6, the elongated shoulder 70 extends substantially above an associated opening 40 in a bail ear (FIG. 5). The shoulder provides a substantial mass to the connecting means.

Extending axially from the shoulder 70 is a projection bayonet 72. Extending outwardly from and formed on the terminal end of projection is a circular cap 74, the lower circumference of the cap extending below the remainder of the bail handle B. The cap has a convex surface with a tapered conformation that increases in radial dimension as it extends axially from the outer, terminal end of the projection toward the shoulder 70. The tapered conformation defines a ramp portion 76 and a constant diameter portion 78. The cap terminates at a region spaced from the shoulder 70 to define a recess 80. The recess 80 has a lateral or axial dimension adapted to accommodate the wall thickness of mounting face 38 of the bail ear.

As best illustrated in FIG. 5, the connecting means 56 at each end of the bail handle is advanced toward the opening 40 in a bail ear. If the opening is a key shaped opening as described above, the recess 80 is simply advanced into the flared portion 41 thereof and continued advancement snap engages the end of the bail handle into the rounded opening. The flared portion elastically expands to accommodate the bail handle end and then relaxes into its undeformed state that prevents removal of the bail handle end from the rounded opening.

Alternatively, if the opening is simply an aperture formed in the mounting face, the cap 74 is pressed into the opening, and ramp portion 76 expands the diameter of the aperture. Once the constant diameter portion 78 of the cap is advanced through the aperture, the mounting face 38 snaps radially inward into the recess 80, preventing removal of the bail handle end.

Under either arrangement, the shoulder 70 is thus closely located adjacent the mounting face 38 of the bail ear so that any pull out forces exerted on the handle provides for abutting engagement between the shoulder 70 and the bail ear. Because of the increased mass of the shoulder 70, the connecting means is better able to withstand shearing forces. In conjunction with the lateral offset, the shoulder also assists in spacing the bail outwardly from the container to accommodate a lid. Further, the combination of the lateral offset and placement of the lower circumference of the cap 74 below the remainder of the bail handle B allows for an increase in the ease of movement of the bail handle. Still further, the solid cross-sectional conformation of the projection and the cap (FIG. 9) also withstands greater shearing forces as opposed to the hollow, tubular projections used in prior art arrangements. The solid projection and cap have more material over which the forces can be distributed, permitting them to withstand overall greater forces.

The above-described container and new plastic bail handle provides an all plastic container that is compatible with metal detectors used for monitoring purposes. It also eliminates the problems associated with commingled products. More importantly, though, the subject arrangement is more reliable, providing an easy to assemble connection that is sturdier and less likely to break than known structures.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A bail handle comprised of a unitary, flexible plastic material particularly useful for lifting support of an associated container wherein the handle is selectively securable to the container at a container bail ear, the bail handle comprising:

an elongated central portion;

a mounting member at a terminal end of the handle having a handle end portion extending generally parallel to the elongated central portion; and, an interconnecting portion intermediate the mounting member and the central portion, the interconnecting portion depending front the central portion at a first angular offset and from the handle end portion at a second angular offset, and including a reinforcing member centrally disposed along a wall of the interconnecting portion and extending between said first and second angular offsets to rigidify the mounting member handle end portion relative to the interconnecting portion and absorb tensile stress forces imposed on the handle during handle lifting of the container when the offsets will tend to flex.

2. The bail handle as defined in claim 1 wherein the first and second angular offsets define a sloping disposition of the interconnecting portion relative to the central portion.

3. The bail handle as defined in claim 1 wherein the reinforcing member extends generally perpendicularly from the handle end portion and is integrally coextensive of both the handle end portion and the interconnecting portion to buttress the second angular offset.

* * * * *